US005953189A

United States Patent [19]

Abot et al.

[11] Patent Number: 5,953,189

[45] Date of Patent: Sep. 14, 1999

[54] CIRCUIT FOR THE PROTECTED POWER SUPPLY OF AN ELECTRICAL LOAD

[75] Inventors: Jean Abot, L'Isle Adam; Alain Gousset, Nanterre; Nicolas Hertzog, Rueil Malmaison, all of France

[73] Assignee: Schneider Electric SA, Boulogne Billancourt, France

[21] Appl. No.: 08/854,164

[22] Filed: May 9, 1997

[30] Foreign Application Priority Data

May 10, 1996 [FR] France ..... 96 05956

[51] Int. Cl.[6] ..... H01H 9/30

[52] U.S. Cl. ..... 361/13; 361/5

[58] Field of Search ..... 361/2, 3, 5, 6–10, 361/13

[56] References Cited

U.S. PATENT DOCUMENTS 3,868,549 2/1975 Schaefer et al. ..... 361/8

4,725,911 2/1988 Dieppedalle et al. ..... 361/8

FOREIGN PATENT DOCUMENTS 0 633 584 1/1995 European Pat. Off. .

2 227 624 11/1974 France .

*Primary Examiner*—Ronald W. Leja

*Attorney, Agent, or Firm*—Oblon, Spivak, McClelland, Maier & Neustadt, P.C.

[57] ABSTRACT

A circuit for the protected alternating current power supply of an electrical load, the circuit including, in series, a protective circuit breaker and a bi-directional electronic switch in parallel to which a shunt contactor is connected. An electrical component is connected in series and upstream from the shunt contactor. The electrical component is intended to establish a continuous voltage (V) at the terminals of the electronic switch and its impedance is chosen in such a way that the electronic switch to which command pulses are sent periodically, is made a conductor, when an overload current appears in the circuit and when the contactor is closed.

8 Claims, 2 Drawing Sheets

CIRCUIT FOR THE PROTECTED POWER SUPPLY OF AN ELECTRICAL LOAD

BACKGROUND OF THE INVENTION

1. Field of the Invention

This invention relates to a circuit for the protected alternating current power supply of an electrical load, this circuit including an electromechanical protective circuit breaker and a bi-directional electronic switch positioned in series, downstream from the protective circuit breaker and driven by a command device in order to provide a graduated operation of the load, and a shunt contactor which ensures a continuous operation of the load is mounted in parallel to the electronic switch.

2. Discussion of the Background

Such a circuit is known from Patent Application EP 633584. The electronic device is used for the progressive starting and stopping periods of the load while the shunt contactor is used outside these periods in order to prevent heating up of the electronic switch.

The role of the protective circuit breaker is to protect the principal current path in the event that a fault current is detected; its response time is however too long to effectively protect the electronic switch or the shunt contactor during operation.

In order to remedy this disadvantage, it is known, on the one hand, to shunt the electronic switch with a spark gap device in order to divert the current, and on the other hand, to oversize the shunt contactor in order to avoid welding of the contacts.

Oversizing the shunt contactor nevertheless poses a problem of space and of cost.

SUMMARY OF THE INVENTION

This invention therefore has the aim of using a shunt contactor of standard dimensions the protection of which is nevertheless ensured when a fault current is detected.

According to the invention, the power supply circuit is characterised in that an electrical component intended to establish a continuous voltage at the terminals of the electronic switch is connected in series with the shunt contactor and upstream from it.

The electrical component preferably includes a resistance or a transformer whose impedance is chosen in a manner that the electronic switch to which command pulses are sent periodically, is made a conductor, at the time an overload current arises in the circuit and during a phase of continuous operation of the load.

The description which follows, making reference to the appended drawings, will permit the characteristics and advantages of the invention to be explained.

DESCRIPTION OF THE PREFERRED EMBODIMENTS

Figure 1:
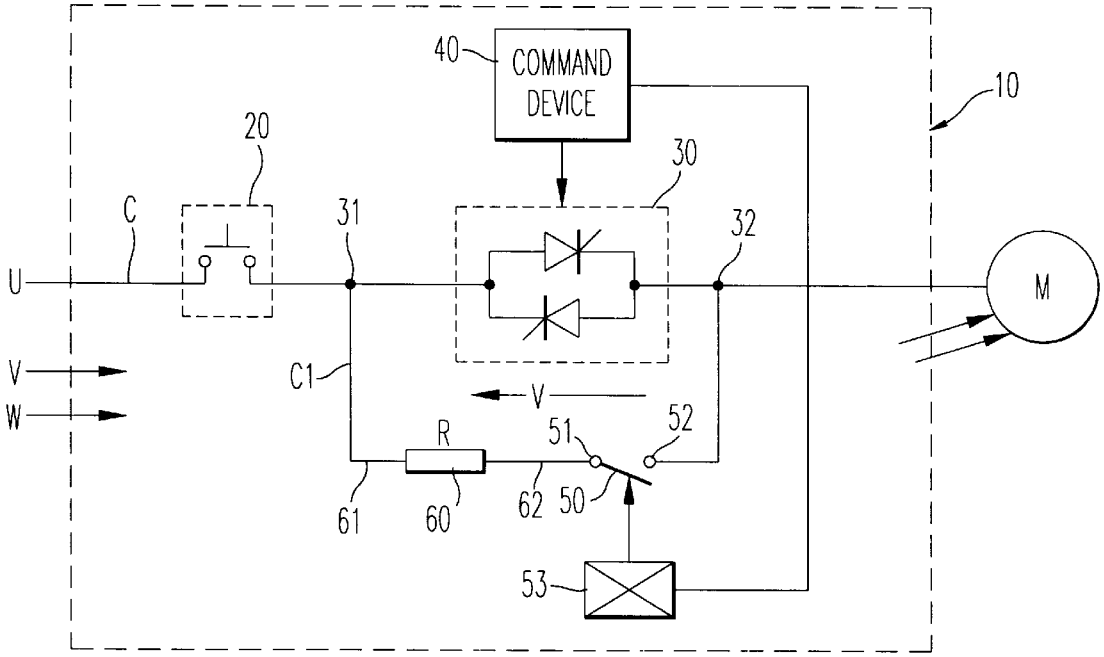
FIG. 1 is a simplified diagram of a power supply circuit of an electrical load according to the invention.

FIG. 1 shows a power supply circuit 10 of an electrical load such as a mono- or polyphase motor M. The power supply circuit 10 is connected to the conductors of a three phase U, V, W mains supply.

Between the mains supply and the motor, on one or several phases and in series there are an electromechanical protective circuit breaker 20 and an electronic switch 30; the electronic switch 30 is driven by a command device with pulse modulation 40 in order to modulate the energy supplied to the motor. For reasons of convenience, only the elements relating to one of the phase lines of the circuit are represented.

The motor M is only supplied when the electromechanical protective circuit breaker 20 such as a cut-out switch that includes moving contacts that work with fixed contacts, is closed, since the command device 40 has closed the electronic switch 30, the current passing via a principal current path C.

The electronic switch 30 is driven by the pulse modulation command device 40 to thereby form an electronic graduator so as to supply gradually increasing or decreasing energy to the motor during the starting up and slowing down phases in a manner that provides progressive change.

The electronic switch 30 is constituted by two thyristors mounted in parallel and in opposite directions or by any other controllable bi-directional semi-conductor switch; electronic switch 30 is connected by an upstream terminal 31 to the electromechanical protective circuit breaker 20 and by a downstream terminal 32 to the motor M.

Connected in a known manner, in parallel with the electronic switch 30, on a derived current path C1, there is an electromechanical shunt contactor 50 that includes main contacts 51, 52; the contactor also includes an electromagnet, the coil of which 53 has terminals connected to the command device 40 and which determines the opening and the closing of contacts 51, 52. These contacts 51, 52 are closed, apart from during the starting up and braking phases of the motor, whenever one wishes to supply the motor with unmodulated energy. The diversion of the current via path C1 of the contactor 50 allows heating up of the thyristors to be avoided.

Finally, in series and upstream from the shunt contactor 50, an electrical component 60 is connected capable of establishing a continuous voltage V at the terminals of the thyristors when the contacts 51, 52 of the contactor are closed. The electrical component 60 has an upstream terminal 61 connected to the upstream terminal 31 of the electronic switch 30 and a downstream terminal 62 connected to the upstream terminal 51 of the contactor 50 whose downstream terminal 52 is connected to the static switch 30.

Figure 2:
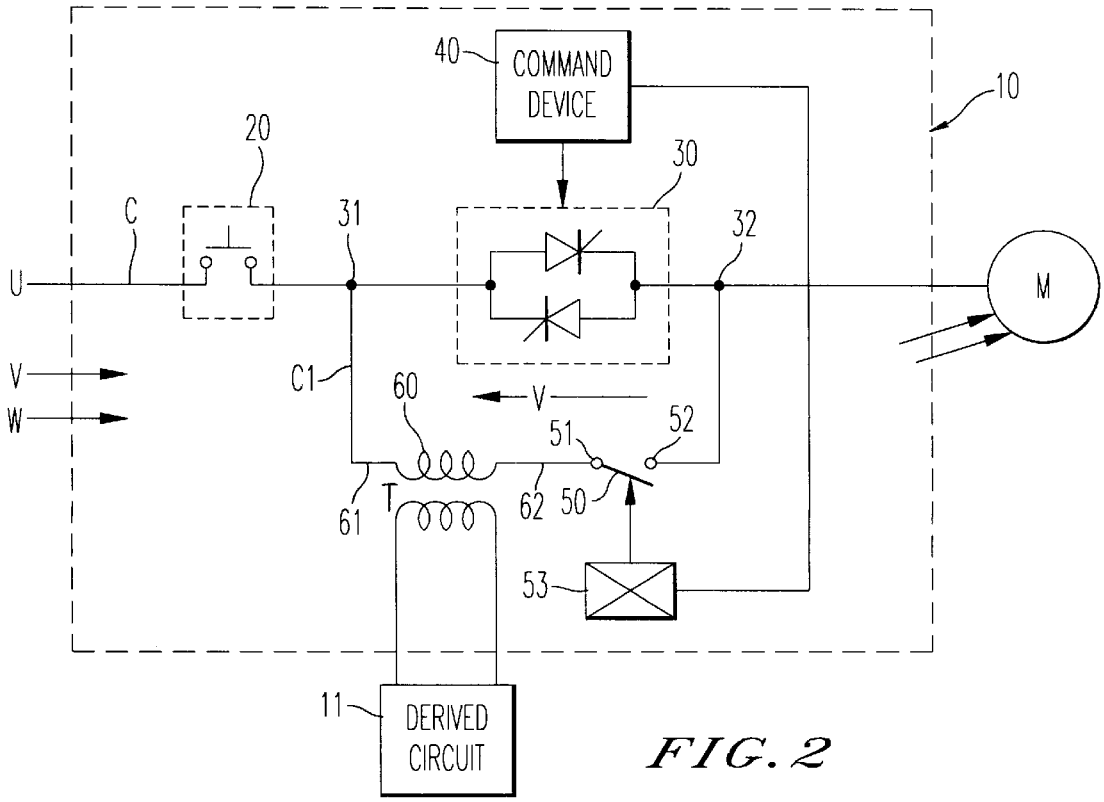
FIG. 2 is a variant of the embodiment illustrated in FIG. 1.

The electrical component 60 can be constituted by a resistance R (FIG. 1) or by a transformer T (FIG. 2). The use of the transformer T can allow power supply to a derived circuit 11 of circuit 10.

The impedance of the resistance R or the impedance of the primary of the transformer T is chosen in such a way that a sufficient voltage V is established so that the thyristors, to which the device 40 is continually sending command pulses, are conductors for the passage of an overcurrent on the principal current path C.

Figure 3:
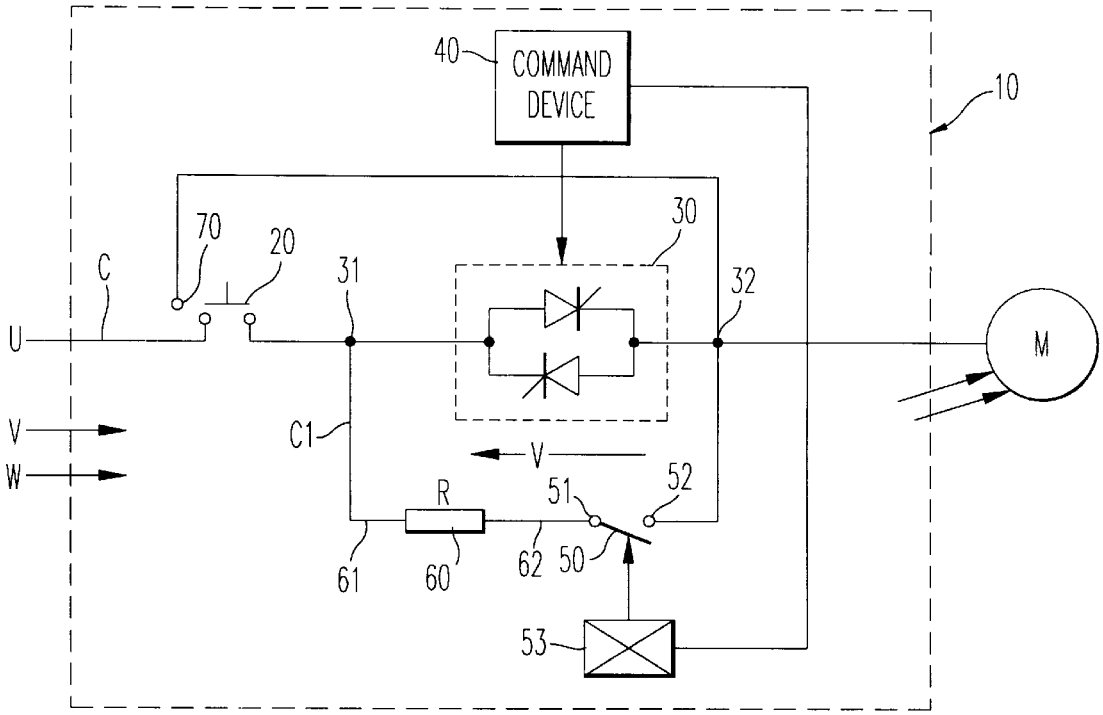
FIG. 3 represents the power supply circuit of FIG. 1 to which a spark gap device is connected.

FIG. 3 shows the circuit of FIG. 1 to which a spark gap electrical device 70 of known type has been added linked to the switch 20. The device 70 is for example a spark transfer electrode, situated on the one hand a short distance from the upstream fixed contact of the switch 20 connected to the mains, and connected on the other hand to the downstream terminal 32 of the electronic switch 30. The function of device 70 is to protect the electronic switch 30, during one phase of its operation, by diverting the current when an overcurrent arises on the principal current path C so as to prevent the arc current generated when the contacts of switch 20 are opened, passing through switch 30.

The operation of the power supply circuit occurs in the following manner.

The protective circuit breaker 20 is closed, then the command device 40 applies turn-on and turn-off signals to the command electrode of the thyristors to make the thyristors conductors or non-conductors at the start-up phase of the motor M while the contactor 50 remains open.

When the motor M has reached a nominal speed, the command device 40 shunts the thyristors by closing contactor 50 which supplies continuous energy to the motor M, the current circulating in the thyristors then being zero.

When the contactor 50 is closed, the device 40 continuously sends command pulses to the thyristors which however are not conductors because the voltage V at their terminals remains less than the threshold triggering voltage.

Figure 4:
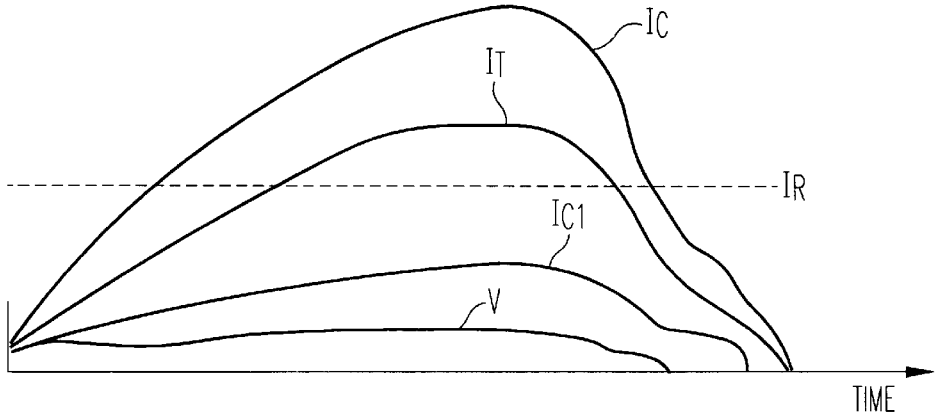
FIG. 4 represents curves of the electrical values of the circuit when an overload arises.

FIG. 4 illustrates the current throughput in the circuit and the voltage at the terminals of the thyristors when an overload current, due for example to a short circuit, appears on the current path C. During the short instant between the detection of the overload current and the opening of the contacts of the switch 20, the current $I_C$ of the main path C increases, generating an increase in the current $I_{C1}$ passing through the current path C1 when the shunt contactor 50 is closed. Because of the presence of the resistance 60, the increase in the current $I_{C1}$ causes the increase in the voltage V at the terminals of the electronic switch 30 to reach the triggering voltage, which causes the conduction of the thyristors and hence the passage by them of a current $I_T$ representing a part of the current $I_C$.

Hence, at the time of an overcurrent, the current $I_{C1}$ increases but remains less than the repulsion current $I_R$ of the contactor corresponding to welding of the contacts.

We claim:

1. A circuit for power supply of an electrical load, comprising:

a protective circuit breaker connected to the electrical load;

a bidirectional electronic switch positioned in series with and downstream from the protective circuit breaker;

a command device which drives the bi-directional electronic switch to provide gradually increasing or decreasing energy to the electrical load to provide a graduated operation of the electrical load;

a shunt contactor in parallel with the bi-directional electronic switch providing unmodulated energy for a continuous operation of the electrical load; and an electrical component connected in series with the shunt contactor and upstream from the shunt contactor to establish a continuous voltage at terminals of the bi-directional electronic switch, an impedance of the electrical component chosen so that the bi-directional electronic switch is made a conductor at a time an overload current appears in the circuit and during a phase of continuous operation of the electrical load.

2. A power supply circuit according to claim 1, wherein the electrical component includes a resistance.

3. A power supply circuit according to claim 1, wherein the electrical component includes a transformer.

4. A power supply circuit according to any one of claims 1–3, further comprising a spark gap device shunting the bi-directional electronic switch when an overload current arises during graduated operation of the electrical load.

5. A circuit for the power supply of an electrical load comprising:

protective circuit breaker means connected to the electrical load;

bi-directional electronic switch means positioned in series with and downstream from the protective circuit breaker means;

command means for driving the bi-directional switch means for providing gradually increasing or decreasing energy to the electrical load to provide a graduated operation of the electrical load;

shunt contactor means in parallel with the bi-directional electronic switch means for providing unmodulated energy for a continuous operation of the electrical load;

electrical component means in series with the shunt contactor means and upstream from the shunt contactor means for establishing a continuous voltage at terminals of the bi-directional electronic switch means, an impedance of the electrical component means chosen so that the bi-directional electronic switch means is made a conductor at a time an overload current appears in the circuit and during a phase of continuous operation of the electrical load.

6. A power supply circuit according to claim 5, wherein the electrical component means includes a resistance means.

7. A power supply circuit according to claim 5, wherein the electrical component means includes a transformer means.

8. A power supply circuit according to any one of claims 5–7, further comprising spark gap means for shunting the bi-directional electronic switch means when an overload current arises during graduated operation of the electrical load.

* * * * *